US005191744A

United States Patent [19]

Bowes

[11] Patent Number: 5,191,744

[45] Date of Patent: Mar. 9, 1993

[54] CONSTRUCTION ELEMENT

[76] Inventor: Keith D. Bowes, P.O. Box 557, Glen Innes, New South Wales, Australia

[21] Appl. No.: 701,096

[22] Filed: May 16, 1991

[30] Foreign Application Priority Data

May 17, 1990 [AU] Australia ..... PK 0198
Sep. 21, 1990 [AU] Australia ..... PK 2440

[51] Int. Cl.[5] ..... E04C 1/10

[52] U.S. Cl. ..... 52/564; 52/600; 52/606; 52/607; 52/585

[58] Field of Search ..... 52/562, 563, 564, 565, 52/570, 561, 596, 600, 604, 605, 606, 607, 612, 585, 436–439

[56] References Cited

U.S. PATENT DOCUMENTS 2,736,188 2/1956 Wilhelm ..... 52/606 X
3,998,022 12/1976 Muse ..... 52/585 X
4,485,604 12/1984 Palamara et al. ..... 52/606 X
4,597,236 7/1986 Braxton ..... 52/606 X

FOREIGN PATENT DOCUMENTS 449884 8/1949 Italy ..... 52/607
89495 11/1958 Netherlands ..... 52/606

*Primary Examiner*—Richard E. Chilcot, Jr.
*Attorney, Agent, or Firm*—Roth & Goldman

[57] ABSTRACT

The invention provides a construction element having a front face (1), a back face (2), a top face (3), a bottom face (4) and end faces (5) and (6). Each of the top (3), bottom (4) and end faces (5) and (6) contains a channel (7) having side walls (8) joined by a base (9) and arranged so as to surround the periphery of the construction element. An aperture (12) is formed between the top face (3) and bottom face (4). The aperture (12) is hexagonal in cross-section. In each channel (7), each side wall (8) forms an angle of 120 degrees with the base of channel (7).

8 Claims, 4 Drawing Sheets

CONSTRUCTION ELEMENT

Figure 2:
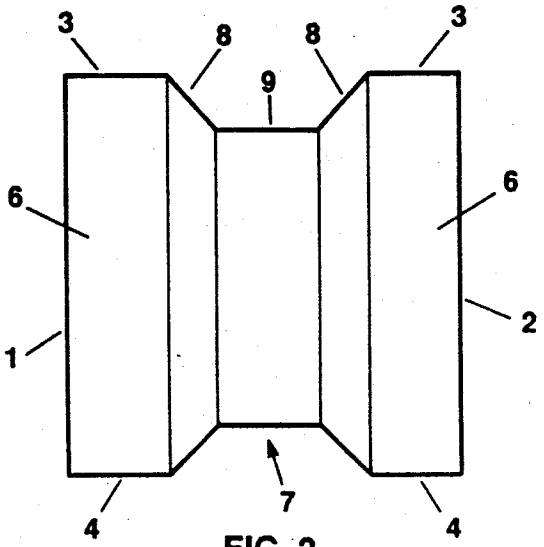

This invention relates to construction elements. More particularly, this invention concerns construction elements which are capable of use in the construction of buildings, walls and other structures and which are also suitable for use in the field of toys or educational apparatus.

In relation to building construction and the like, it is well known that the existing brick or cement block construction requires a substantial degree of expertise. It is essential to use the correct mortar mix and to maintain a uniform mortar gap between successive courses of bricks or blocks. This usually requires the skills of a trained tradesman which increases the cost of construction. In addition, the use of mortar results in a rigid structure, so that cracks readily appear after only relatively slight foundation movement.

It is an object of this invention to overcome or at least substantially alleviate some or all of the disadvantages of prior art building construction. It is also an object of the invention to provide a construction toy which is both educational and entertaining.

Accordingly, in its broadest aspect, this invention provides a construction element having front, back, top, bottom and end faces, each of said top, bottom and end faces containing a channel having side walls joined by a base and arranged so as to surround the periphery of said element, and an aperture formed between the top and bottom faces, characterized in that the aperture is hexagonal in cross-section and further characterized in that in each channel each side wall forms an angle of approximately 120 degrees with the base of the channel.

As described later in more detail, the hexagonal aperture formed between the top and bottom faces can allow vertical keyways to be formed through a structure to receive reinforcement.

As indicated above, each of the angles formed between the side walls of the channel and its base is 120 degrees, and the aperture forms a regular hexagon in dross-section, the angles of which hexagon are also 120 degrees.

The advantages of this configuration are found at least partly in the load-bearing capacity of the construction element of the invention, which is substantially higher than if there were a curve between the side walls of the channel and the base, for example, or if the angles were right angles. Another advantage is found in the stability and strength of the finished structure, especially in the field of building construction.

When a plurality of the construction elements of the invention are intended for use in the field of building construction and are laid in courses, they may be reinforced by longitudinal reinforcement means, such as rods. However, reinforcement may also be effected by using mortar or similar material. This is especially so when the elements are provided with apertures, since the mortar or the like may spread within the elements both horizontally and vertically to result in a structure with appreciable structural strength.

For use in building construction, the element of the invention may be manufactured from cement and may carry a decorative pattern, for example, so that at least the front face resembles a sandstone block. In this application, the construction element would normally be made in sizes useful for building, such as 300 mm high by 600 mm long and 300 mm in depth.

When the construction element of the invention is intended for use as a toy or as part of educational apparatus, it will be most convenient if each construction element is of a smaller, more easily handled, size such as 50 mm high by 100 mm long and 50 mm in depth, for example. In this application, the element is preferably made of plastic or some other suitably lightweight yet durable material.

When using the element of the invention as a toy or for educational purposes, various linking devices may be used to reinforce or join the elements. These are conveniently made of plastic.

When the construction element of the invention has the preferred feature wherein the angles formed between the side walls of the channel and its base are 120 degrees, and if the aperture forms a regular hexagon in cross-section, the angles of which hexagon are also 120 degrees, the simplest reinforcement or linking device takes the form of a rod, which is a regular hexagon in cross section and is designed to fit snugly into a hexagonal aperture formed between the top and bottom faces of the element in the preferred embodiment, or between abutting elements. Such a rod can help to stabilise adjacent elements when they are laid in a staggered fashion. The rod may also be inserted vertically so as to pass alternately down through the centres of elements in one course and through keyways formed between the edges of abutting elements.

Another form of reinforcement or linking device may be of T- or L-shape, so that, especially when using the element of the invention as a toy or teaching aid, a plurality of different configurations is possible; construction is not limited to staggered courses. Each element may be offset from the other, for example. Still another form of linking device is of cruciform shape: this expands still further the ways in which elements of the invention may be linked together.

The reinforcement or linking device may be of any suitable dimension but preferably the longest dimension of the device is somewhat less than the shortest dimension of the construction element, except where the linking is linear.

It is also contemplated that the reinforcement or linking device is provided in modular form, so that desired shapes such as linear, T, L or cruciform may be constructed as any suitable manner, for example, by snap-fit ball and socket fittings.

Figure 1:
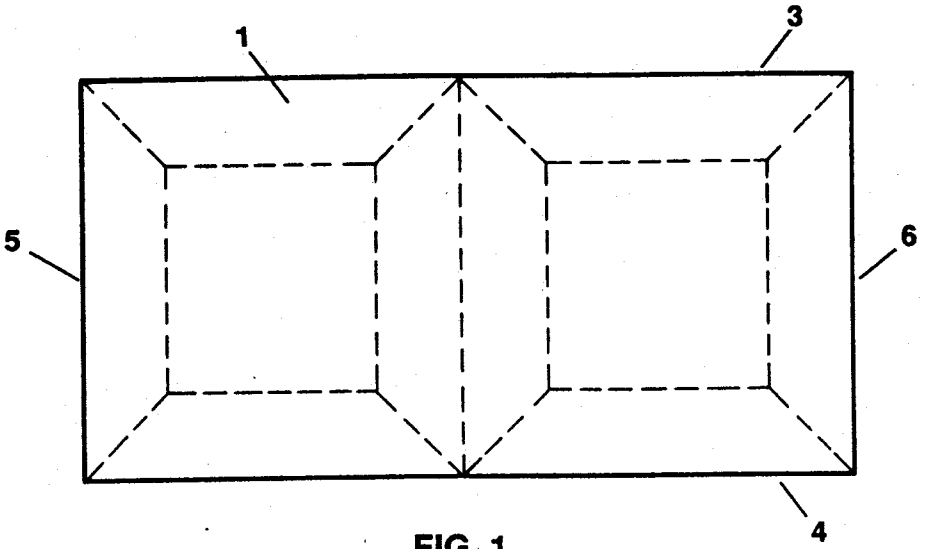
Figure 3:
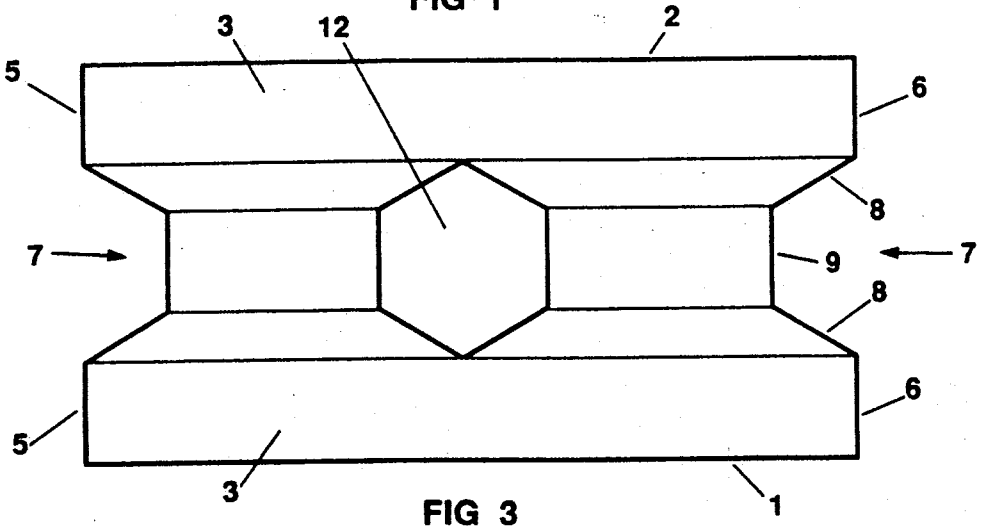
Figure 5:
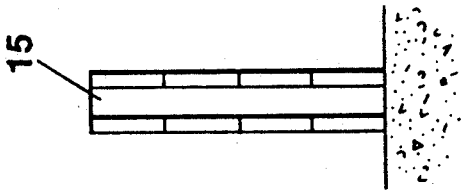
Figure 4:
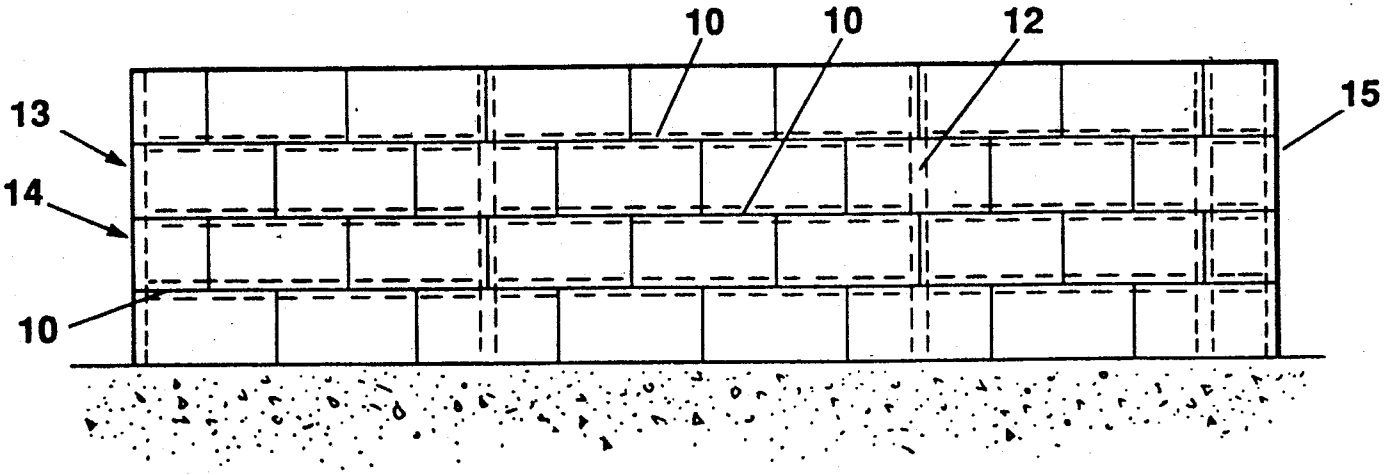
Figures 6, 7:
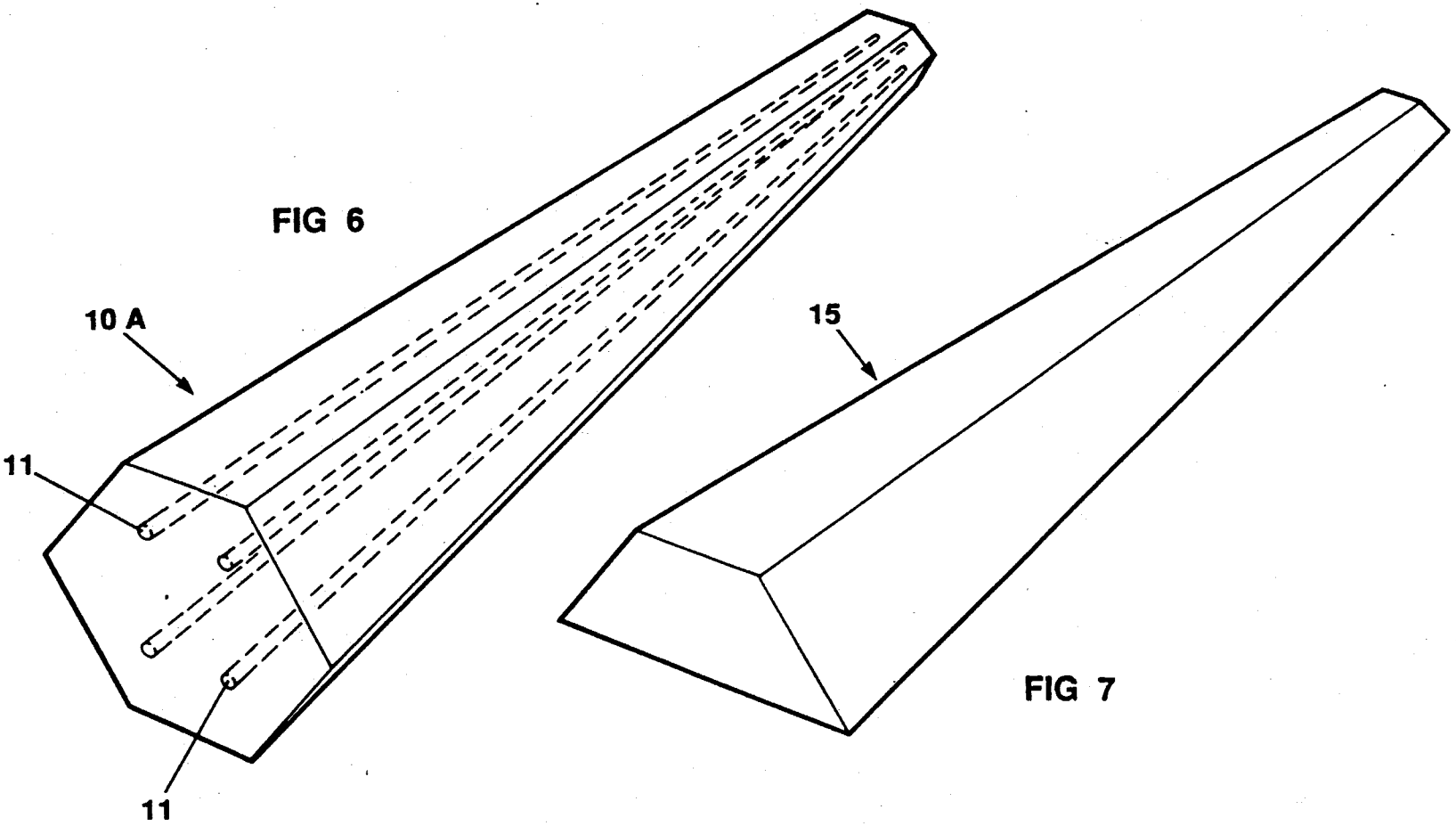
Figure 8:
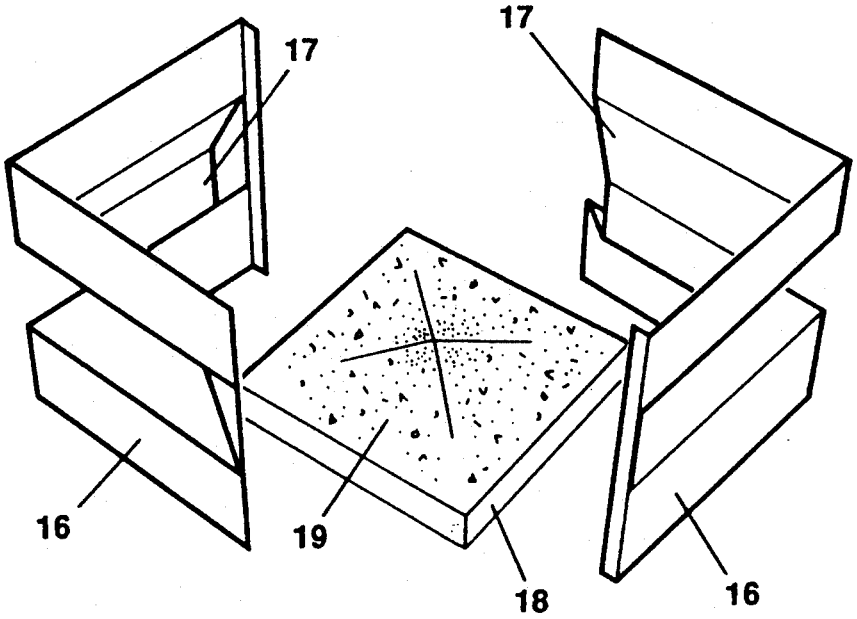

The invention will now be described with reference to the attached Drawings, in which:

FIGS. 1, 2 and 3 respectively illustrate elevation, plan and end views of an embodiment of a construction element according to the invention, FIGS. 4 and 5 show elevation and end views of a wall structure constructed using the elements of FIGS. 1, 2 and 3, FIG. 6 shows a perspective view of a reinforcement device for use with the elements of FIGS. 1, 2 and 3, FIG. 7 shows a second form of reinforcement device, and FIG. 8 shows the parts of a mould for forming one version of a construction element of the invention.

Referring first to FIGS. 1 to 3, the element may be formed from cement and have a rectangular shape with front and back faces 1 and 2, top and bottom faces 3 and 4 and end faces 5 and 6. Although not shown by the drawings, the front face of the element may carry a decorative pattern to represent, for example, a cut sandstone block. While the invention is not limited to any particular size for the element, in the case of the element illustration the front and back faces may be 300 mm high by 600 mm in length and the top, bottom and end faces may be 300 mm in width.

In accordance with this invention, a channel 7 is formed along each of the top, bottom and end faces so as to extend completely around the block. In this embodiment, the channel is 65 mm deep with sloping sides 8 and a flat bottom 9. Although the channel is shown centred between each of the faces, this is not essential to the invention as the channel may in fact be offset from the centre towards either the front or back of the block.

When a plurality of elements are laid in a staggered fashion as shown by FIGS. 4 and 5, channels 7 combine to form keyways 10 extending the length of the structure between adjacent courses of elements. Placement of longitudinal reinforcement devices along these keyways will serve to lock the structure together without the need for mortar between the blocks while at the same time allowing a limited degree of movement. A strong and robust structure is thus provided which is still able to tolerate minor foundation displacement without cracking. It is of course permissible to use mortar if desired.

One suitable form of reinforcement device 10A is shown in FIG. 6. Preferably, device 10A is constructed of concrete with steel rods 11 running the length of the device. In cross-section the device 10A is hexagonal so as to correspond in shape and fit within the keyways 10 formed between the elements.

As an additional preferred feature, an aperature 12 may also be formed down through the centre of the element between the top and bottom faces 3 and 4. The shape and dimensions of this aperture 12 are such as to receive the aforementioned reinforcement device in the vertical direction. Thus, in the case of the wall shown in FIGS. 4 and 5, reinforcement device 10A could be placed vertically so as to pass alternately down through the centres of the elements in one course 13 and through the keyways formed between the edges of abutting elements in adjacent courses 14. Appropriate gaps in the longitudinal reinforcement devices 10A would of course have to be allowed for these vertical devices.

A second form of reinforcement device 15 is shown in FIG. 7. This device is adapted for placement along the extremities of a wall structure and sits within the open channel remaining along the exposed ends of the elements. It thus acts as a capping and provides a finished appearance for the wall as well as an additional measure of vertical reinforcement.

One type of mould for an element according to this invention is shown in FIG. 8. The mould comprises two interfitting right angled sections 16 with indentations 17 on the interior walls to form the aforementioned channel 7. There is also a base plate 18 which fits within the assembled mould sections. This plate preferably has a textured upper surface 19 so as to imprint any desired face onto the moulded element. With the preferred embodiment this is designed to produce an element having the appearance of cut sandstone.

In use the two sections 16 are assembled around the base place 18 and a cement mixture is poured into the resulting cavity. Before the mixture hardens completely the mould is inverted and the base plate removed to leave the desired textured face. To assist this operation any suitable type of release agent may be applied to surface 19 prior to the moulding operation.

It will be appreciated that the present invention is capable of use in various fields. Other forms of the invention and methods of use will be apparent to one skilled in the art and the invention is not to be limited by the specific examples referred to herein.

The claims defining the invention are as follows:

1. A construction element having front, back, top, bottom and end faces, each of said top, bottom and end faces containing a channel having side walls joined by a base and arranged so as to surround the periphery of said element and an aperture formed between the top and bottom faces, characterized in that the aperture is hexagonal in cross-section and further characterized in that in each channel each side wall forms an angle of approximately 120 degrees with the base of the channel.

2. A construction element as claimed in any one of claim 1, wherein the aperture is adapted to receive a reinforcement or linking device.

3. A construction element as claimed in any one of claim 1, in which the channels are adapted to form a continuous horizontal keyway when a plurality of elements is laid in successive courses.

4. A construction element as claim in claim 1 in which the keyway is adapted to receive a reinforcement or linking device.

5. A construction element as claimed in any one of claims 1, 2, 3, or 4, which is intended for use as a toy.

6. A construction element as claimed in any one of claims 1, 2, 3, or 4, which is intended for use in building construction.

7. A construction element as claimed in claim 2, wherein the reinforcement or linking device is a rod of hexagonal cross-section.

8. A construction element as claimed in claim 4, wherein the reinforcement or linking device is a rod of hexagonal cross-section.

* * * * *